United States Patent [19]

Bridwell

[11] 4,130,064

[45] Dec. 19, 1978

[54] ENERGY GENERATING SYSTEM FOR A ROADWAY OR RAILWAY

[76] Inventor: Phillip P. Bridwell, R.R. #1, P.O. Box 535, Anna, Ill. 62906

[21] Appl. No.: 752,612

[22] Filed: Dec. 20, 1976

[51] Int. Cl.[2] ..... F04B 9/00

[52] U.S. Cl. ..... 104/154; 417/229

[58] Field of Search ..... 104/147R, 154, 155, 104/157, 162, 164; 180/650; 92/65; 60/557, 668; 417/229, 265, 487, 488

[56] References Cited

U.S. PATENT DOCUMENTS

| | | | |
|---|---|---|---|
| 1,771,200 | 7/1930 | Akers | 417/229 |
| 3,128,721 | 4/1964 | McGowan | 104/162 |
| 3,312,146 | 4/1967 | Quere et al. | 92/65 |
| 3,373,699 | 3/1968 | Bick et al. | 104/162 |
| 3,513,781 | 5/1970 | Schulte et al. | 104/162 |
| 3,771,461 | 11/1973 | Giraud | 104/154 |
| 3,803,422 | 4/1974 | Krickler | 417/229 |
| 3,848,541 | 11/1974 | Hondzinski | 104/155 |
| 3,861,487 | 1/1975 | Gill | 180/65 D |
| 3,918,844 | 11/1975 | Bailey | 417/229 |
| 4,004,422 | 1/1977 | LeVan | 60/668 X |

FOREIGN PATENT DOCUMENTS

| | | | |
|---|---|---|---|
| 2345445 | 3/1975 | Fed. Rep. of Germany | 92/65 |

*Primary Examiner*—Albert J. Makay
*Assistant Examiner*—Ross Weaver
*Attorney, Agent, or Firm*—Albert L. Jeffers; John F. Hoffman

[57] ABSTRACT

A system for utilizing the weight and momentum of moving vehicles to produce usable energy comprising a fluid displacement pump positioned either under a moveable plate in a roadway or between the rail and railbed in a railway which compresses a fluid such as air or hydraulic fluid as the vehicle passes over, a low pressure line for supplying fluid to the pump chamber, a high pressure outlet line communicating with the chamber and connected to a manifold which is supplied with high pressure fluid from a number of other similar pumps and which directs the fluid to an energy conversion device such as a fluid motor and electric generator, or a fluid motor driving an air compressor, or to a fluid motor driving machinery in a factory or other industrial plant.

12 Claims, 9 Drawing Figures

ENERGY GENERATING SYSTEM FOR A ROADWAY OR RAILWAY

BACKGROUND OF THE INVENTION

The present invention relates to the production of usable energy whereby the weight and momentum of passing vehicles such as trains or cars and trucks actuates a pump mounted within the roadway or railway to compress air or pressurize hydraulic fluid in an output line or manifold. The high pressure fluid is then utilized to drive a device such as a fluid motor which converts the energy of the high pressure fluid into usable mechanical energy which in turn may be utilized to drive an electrical generator or the like.

With the increasing shortage in fossil fuels such as coal, oil and natural gas, other sources of energy must be tapped in order to meet industrial and residential requirements. One source of energy which has heretofore not been effectively exploited is the momentum and gravitational potential energy of moving vehicles such as cars, trucks, railroad trains, etc. As a train passes by a given point on a track, tremendous gravitational forces are exerted on the track by virtue of the load supported by each wheel. By utilizing this force to displace a small quantity of hydraulic fluid or a larger quantity of air or other suitable gas, extremely high pressures are generated which may in turn be used to drive a fluid motor coupled to an electric generator or to utilize the fluid in a heat pump or similar device. The high pressure fluid can very easily be transmitted to an industrial operation or to any number of homes through high pressure fluid lines without any substantial loss of pressure. Also, the energy may be utilized to assist in powering the vehicle itself in the case of a railroad train. This is particularly possible in the case where the high pressure fluid is used to generate electric power which may then be transmitted to the train by means of overhead lines or the like.

In order to maximize the power output of such a system, it is necessary that the piston and cylinder, diaphragm, etc. expand immediately after the vehicle wheel has passed thereover so that it can again be charged with the working fluid. In this manner, a large number of short pulses of high pressure fluid can be produced.

SUMMARY OF THE INVENTION

The present invention comprises: an energy generating system comprising roadway means for supporting a moving vehicle which is capable of being depressed by the vehicle as it passes thereover; a fluid displacement pump including a contractible and expansible chamber which is positioned beneath the roadway means; means connecting the roadway means and the chamber for causing the chamber to contract as the vehicle passes thereover; return line means for supplying fluid to the chamber and means for pressurizing the fluid within the return line so as to cause the chamber to expand after the vehicle has passed thereover; an outlet fluid line communicating with the chamber; check valve means associated with the return line means and the output line for permitting fluid flow only into the chamber through the return line and only out of the chamber through the outlet line; and means operatively connected to the output line for converting fluid pressure energy to some other form of energy.

It is an object of the present invention to provide an energy generating system which converts the gravitational potential energy and momentum of passing vehicles into usable energy through the medium of a high pressure fluid.

It is a further object of the present invention to provide an energy generating system wherein maximum utilization of the momentum of the passing vehicle is achieved by charging the pump with a full quantity of fluid after the vehicle wheel passes thereover.

A still further object of the present invention is to provide an energy generating system powdered by passing vehicles which may be easily incorporated into existing roads and railroad tracks.

Yet another object of the present invention is to provide an energy generating system whereby the energy produced by passing vehicles may be stored for future use during light, intermittent traffic conditions.

It is a further object of the present invention to provide an energy generating system which is relatively simple in design and economical to operate.

These and other objects will be apparent from the following description taken together with the drawings.

DETAILED DESCRIPTION

Figure 1:
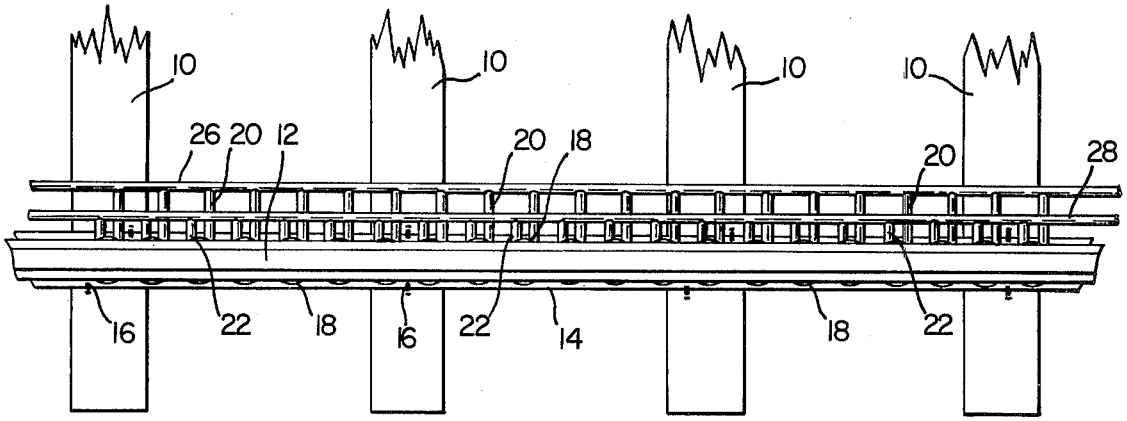
FIG. 1 is a top plan view of a portion of the railway energy generating system according to the present invention.
Figure 2:
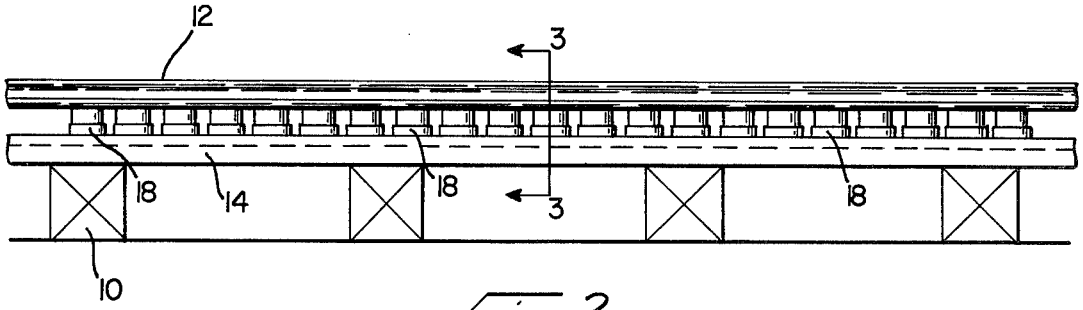
FIG. 2 is a side elevational view of FIG. 1.
Figure 3:
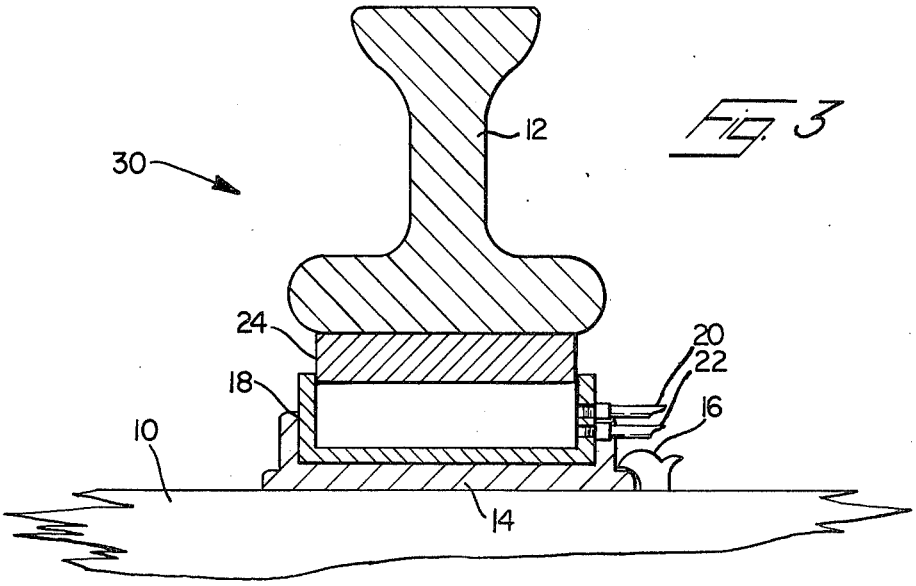
FIG. 3 is a sectional view of FIG. 2 taken along line 3—3 and viewed in the direction of the arrows.

With reference to FIGS. 1, 2 and 3 of the drawings, the energy generating system of the present invention is particularly adapted to be integrated with existing railroad tracks. The track comprises a plurality of cross-ties 10 layed transversely underneath the rails 12 and rail base 14, only one rail and rail base being shown in the drawings. Normally, the ties 10 are supported on a layer of crushed stone or cinders. The rail base 14 is an elongated unit made of steel or other suitable material and formed in sections which are layed against each other in end-to-end relationship and secured to ties 10 by means of spikes 16. Welded or otherwise fastened to base 14 are a plurality of cylinders 18 having inlet and outlet lines 20 and 22, respectively, in fluid communication therewith. Received within each cylinder 18 is a piston 24 which is welded or otherwise secured to rail 12. Piston 24 and cylinder 18 are shown in their simplest form without seals, rings, etc. since the details of their construction is not necessary for an understanding of the invention. A wide variety of piston and cylinder arrangements well known in the art may be utilized in the practice of the invention.

Each of the inlet lines 20 connects to a return manifold 26 through check valves (shown schematically in FIG. 6) which prevents back pressure into the inlet lines 20 and return manifold 26. In a similar fashion, each of the outletlines 22 connects to an outlet manifold 28 through check valves (shown in FIG. 6) which prevents the high pressure fluid from flowing into cylinder 18 during the piston upstroke. Although any number of pumps 30 comprising piston 24 and cylinder 18 may be utilized depending on the pressure and volume output which is desired, a spacing of approximately 2" between each pump is preferred. A certain amount of flexibility in rail 12 is also desirable so that the pistons 24 can rapidly return to their upper or normal positions.

Figure 5:
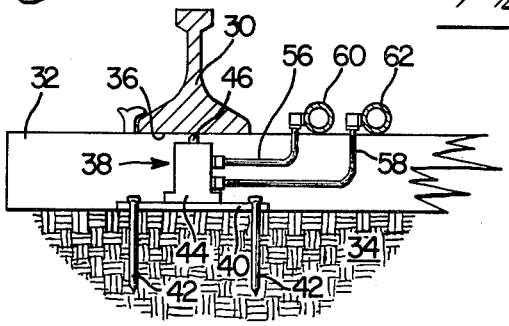
FIG. 5 is a sectional view of FIG. 4 taken along line 5—5 and viewed in the direction of the arrows.
Figure 4:
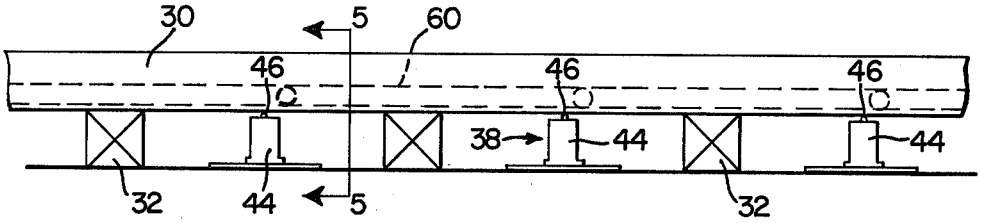
FIG. 4 is a side elevational view of another embodiment of the present invention.

In addition to the embodiment shown in FIGS. 1, 2 and 3 where the railroad track is specially designed for the fluid pumping system of the present invention, it can also be employed in existing railroads wherein the rails are supported directly on the cross-ties. A track of this type is illustrated in FIGS. 4 and 5 wherein the standard rails 30 are supported on cross-ties 32 which in turn rest on a bed of gravel or cinders 34. In this construction, there is a space of 3 or 4 inches between the base 36 of rail 30 and the cinder bed 34. Specially designed pumps 38 are installed between adjacent ties 32 underneath rails 30 on a supporting plate 40 which is anchored by means of augers or spikes 42. If desired, the housing 44 for pump 38 may be welded to plate 40.

Pump 38 includes a piston and cylinder similar to that discussed in conjunction with FIGS. 1, 2 and 3 and has a connecting rod or plunger 46 which projects above the pump housing 44 and by a yoke 50 which connects to the plunger 52 through a pin 54.

A return line 56 and outlet line 58 communicate with the cylinder of pump 38 and are provided with check valves so that the air or hydraulic fluid flows in through line 56 on the upstroke and out through line 58 on the compression stroke. Manifolds 60 and 62 connect to each of the lines 56 and 58, respectively, similarly to the embodiment illustrated in FIG. 1. Again, the number and spacing of the pumps 38 along rail 30 may be varied according to the pressure and volume requirements of the system. In order to make maximum utilization of the passing train, it is preferred that pumps 38 be installed under both rail 30 and its companion rail (not shown).

Figure 7:
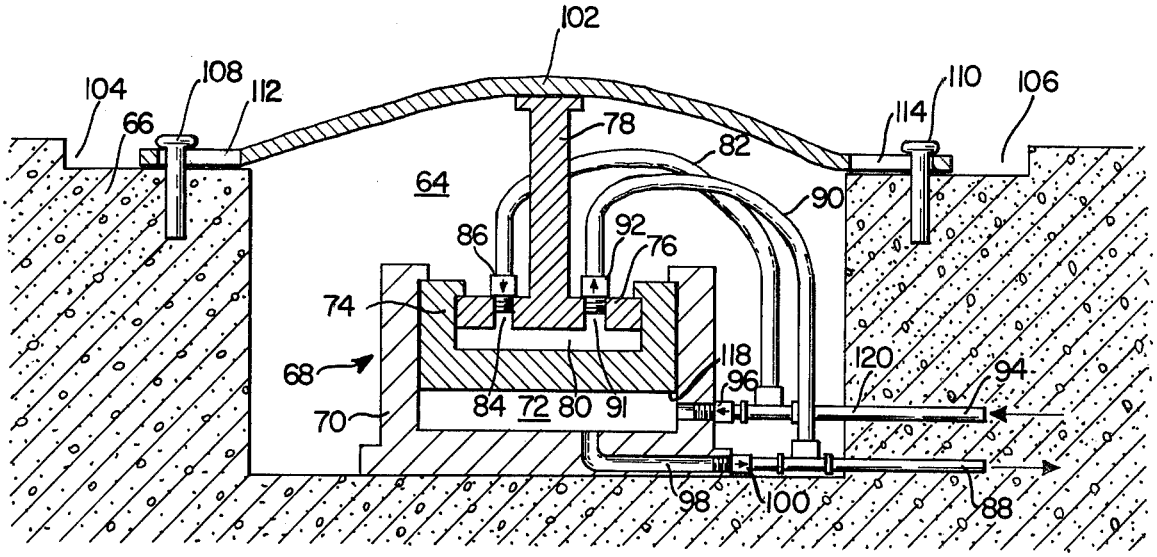
FIGS. 7 and 8 are sectional and top plan views, respectively, of a further embodiment of the invention.

The present invention can also be employed in a paved roadway so as to take advantage of the momentum and weight of passing cars and trucks. Suitable apparatus is illustrated in FIG. 7 wherein a recess 64 in the pavement 66 is provided. The pump is of the dual-stroke type wherein greater volumes of air or hydraulic fluid are pressurized depending on the weight of the passing vehicle.

The pump 68 compresses an auxiliary cylinder 70 having an auxiliary piston 74 thereby forming an expansible chamber 72. Piston 74 also serves as the main cylinder and cooperated with main piston 76 which is provided with a connecting rod or plunger 78. The expansible chamber 80 formed between piston 76 and cylinder 74 is supplied with air or hydraulic fluid through flexible hose 82 which connects with piston port 84 through check valve 86, the latter opening on the upstroke and closing on the compression stroke of piston 76. On the piston compression stroke, high pressure air or fluid is pumped to outlet line or manifold 88 through flexible hose 90 which connects with piston port 91 through check valve 92. Valve 92 opens on the piston compression stroke and closes on the upstroke. Air or hydraulic fluid is supplied to expansible chamber 72 from return line 94 through check valve 96 and the outlet line or manifold 88 connects to chamber 72 through passageway 98 and check valve 100. It should be noted that inlet and outlet lines 94 and 88 are common to the respective inlets and outlets for cylinders 74 and 70.

Positioned over recess 64 is a steel plate 102 which has a limited degree of flexibility. Plate 102 is anchored to the pavement 66 within slightly recessed areas 104 and 106 by spikes, bolts or the like 108 and 110. The spikes 108 and 110 pass through longitudinal slots 112 and 114 so that as the vehicle wheel passes thereover, plate 102 is capable of flattening out. When this occurs, connecting rod or plunger 78 is depressed causing piston 76 to compress the air or fluid within cylinder 74. By virtue of check vavles 86 and 92, the fluid will be pumped through line 90 into high pressure line or manifold 88.

Figure 8:
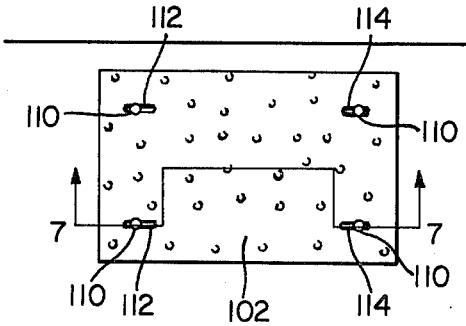
Figure 8:
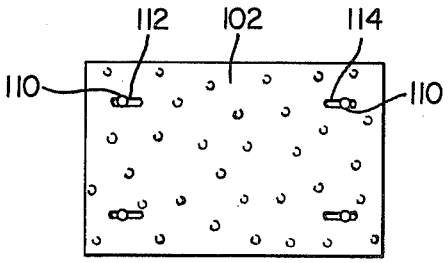

In the case of a normal passenger vehicle such as an automobile, the deflection of plate 102 will be sufficient only to pump the fluid out of expansible chamber 80. If a bus or truck should pass over plate 102, however, piston 76 would be depressed to the point where it contacts the lower surface 116 of cylinder 74 which will also be depressed thereby compressing the air or fluid within cylinder 70. Because of the larger surface area of the face 118 of cylinder 74, a greater volume of fluid will be compressed and pumped through passageway 98, and check valve 100 into high pressure line 88. After the vehicle wheel has passed, plate 102 will return to its normal shape thereby allowing piston 76 and piston/-cylinder 74 to return to their upper or normal positions by virtue of the return line pressure in lines 94, 120 and 82 provided by the return line pump (not shown) or other suitable means as will be discussed in further detail in conjunction with the hydraulic system shown in FIG. 6. In order to make maximum utilization of the weight and momentum of the vehicle and to permit smooth passage over the plate 102, it is preferred that two pumps units spaced so as to be actuated by both wheels on each axle, be provided as shown in FIG. 8.

Figure 6:
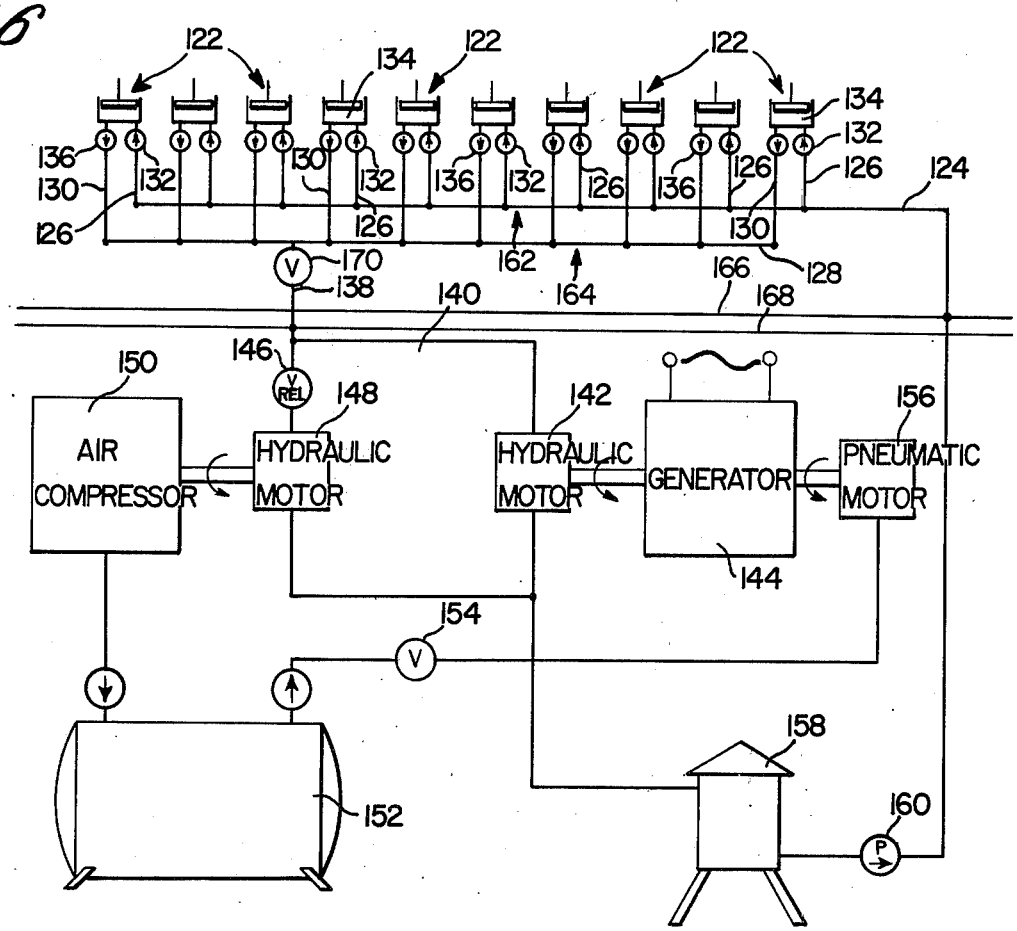
FIG. 6 is a schematic representation of the hydraulic and pneumatic system for the present invention.

Referring now to FIG. 6, the overall hydraulic schematic of the system is illustrated. A plurality of piston and cylinder units 122 are shown connected to return line manifold 124 through return lines 126 and to high pressure manifold 128 through high pressure output lines 130. Check valves 132 on each of the return lines 126 open on the piston upstroke so as to admit hydraulic fluid to the cylinder chambers 134 and close on the compression stroke so that return line back pressure is prevented. Check valves 136 in each of the high pressure lines 130 open on the piston compression stroke and close on the upstroke so as to pump high pressure fluid through conduit 128.

The high pressure hydraulic fluid passes through lines 138 and 140 into fluid motor 142 which drives electric generator 144. If the pressure is sufficiently high, relief valve 146 will open admitting a portion of the pressurized fluid in line 128 to hydraulic motor 148 which drives air compressor 150. The pneumatic pressure generated by compressor 150 is stored in tank 152 for use at times when no traffic is passing over the roadway device shown in FIGS. 7 and 8 or the railroad track system shown in FIGS. 1–6. By opening valve 154, the high pressure air will be admitted to pneumatic motor 156 which is capable of driving generator 144. The hydraulic fluid at the low pressure side of motors 142 and 148 may be stored in any suitable reservor such as an elevated tank 158. The fluid stored in a tank such as 158 will be under pressure at the tank outlet and as it is supplied to the pumps 122 through return line 124, will cause the respective pistons to return to their normal upper positions after the vehicle wheel has passed thereover. In order to maximize efficiency of this system, it is important that there be sufficient pressure in return line 124 to assure that the pistons are raised and their chambers filled with the hydraulic fluid. To accomplish this, a pump 160 may be provided on return line 124.

It is important to note that the hydraulic system shown in FIG. 6 is a representation of the three previously discussed embodiments and that the piston and cylinder units illustrated diagrammatically correspond to piston 24 and cylinder 18 in FIGS. 1-3, pump 38 in FIGS. 4 and 5, and the double stroke pump 68 in FIG. 7. Of course the manner in which the high pressure fluid is utilized to run electric generators, power machinery, etc. depends on the particular application in question and certain modifications of the system shown in FIG. 6 are within the scope of the present invention. Aside from the pump units themselves, the important features of the invention are the provision of means in the high pressure line for converting the pressurized fluid in to usable work and means for providing a certain degree of pressure in the return lines.

In an installation where it is desirable to utilize the momentum of a train or other vehicle travelling down an incline, valves would be provided to open and close the high pressure manifold from the long distance high pressure line. Separately valved manifolds 162 and 164 would be provided for each one mile section of track, for example, and at least one separate manifold for each incline. The manifolds 162 and 164 are connected to long distance fluid lines 166 and 168, with manifold 164 being isolated by valve 170. With a train travelling down the incline, valve 170 would be opened and with a train travelling up the incline, it would be closed so that the train would not be impeded by the localized depression of the track.

Certain other modifications will be obvious from the present disclosure such as the use of diaphragms or other types of pumps for the piston and cylinder units. While this invention has been described as having a preferred design, it will be understood that it is capable of further modification. This application is, therefore, intended to cover any variations, uses or adaptations of the invention following the general principles thereof and including such departures from the present disclosure as come within known or customary practice in the art to which this invention pertains and as may be applied to the essential features hereinbefore set forth and fall within the scope of this invention or the limits of the appended claims.

What is claimed is:

1. A railway track energy generating system comprising:

a rail bed comprising a plurality of cross ties, an elongated rigid rail base secured to said cross ties and being supported thereon, an elongated vehicle supporting rail located above said rail base and being generally coextensive therewith, said rail and rail base having sufficient strength and rigidity to support a train passing thereover, a plurality of piston and operating cylinders mounted underneath said rail between said rail and rail base.

working fluid in said cylinders, said pistons being secured to one of said rail and said rail base and said cylinders being secured to the other of said rail and said rail base, said rail being completely supported and spaced from said rail base by the working fluid in said cylinders, a portion of said piston and cylinders being positioned between adjacent ones of said cross ties and the remainder of said piston and cylinders being positioned above respective said cross ties, return line means for supplying the working fluid to said cylinders, means for pressurizing the working fluid within said return line means, an outlet fluid line communicating with said cylinder, valve means associated with said return line means and said outlet line for permitting fluid flow only into said cylinders through said return line means and only out of said cylinders through said outlet line, and a fluid motor operatively connected to said output line.

2. The apparatus of claim 1 wherein said return line means and said outlet line each includes a manifold.

3. The apparatus of claim 1 including an electric generator driven by said fluid motor.

4. The apparatus of claim 1 wherein said piston and cylinders are hydraulic and said return line means includes means for supplying hydraulic fluid to said cylinders.

5. The energy generating system of claim 4 wherein said fluid motor is a hydraulic motor and including:

a second hydraulic motor connected to said outlet line, a pneumatic compressor driven by one of said hydraulic motors and an electric generator driven by the other of said hydraulic motors, a pneumatic motor drivingly connected to said electric generator, an air accumulator connected to said compressor and having an output line connected to said pneumatic motor, and a valve connected in said accumulator output line.

6. The energy generating system of claim 5 including a low pressure hydraulic reservoir having an inlet line connected to the low pressure side of the other hydraulic motor and an outlet connected to said outlet line, and wherein said means for pressurizing comprises a pump connected between said reservoir outlet and said outlet line.

7. The apparatus of claim 1 including an air compressor driven by said fluid motor and a pneumatic motor operatively connected to said air compressor.

8. The apparatus of claim 7 and including storage tank means between said air compressor and said pneumatic motor for storing pressurized air.

9. The apparatus of claim 7 and including a second fluid motor operatively connected to said outlet line.

10. An energy generating system comprising:

a roadway, movable actuator means in said roadway adapted to be depressed by the wheels of a passing vehicle, a fluid displacement pump comprising: a first piston and cooperating first cylinder, a plunger connected to said first piston and to said actuator means, a second cylinder within which said first cylinder is slidably received, said first piston and first cylinder forming a first expansible and contractible chamber, said first and second cylinders forming a second expansible and contractible chamber, said second chamber having a greater working area than said first chamber, said arrangement providing for an efficient pumping action when the plunger is depressed by vehicles of various weights passing thereof, return line means for supplying fluid to said chambers, an outlet line connected to said chambers, valve means associated with said return line means and said outlet line for permitting fluid flow only into said chambers through said return line and only out of said chambers through said outlet line, and power means operatively connected to said outlet line for converting fluid pressure energy to another form of energy.

11. The energy generating system of claim 10 including a recessed space in said roadway and wherein said actuator means comprises a movable plate disposed over said recessed space and said pump is disposed in said recessed space.

12. The apparatus of claim 11 wherein said plate comprises an arcuate flexible metal sheet.

* * * * *

UNITED STATES PATENT AND TRADEMARK OFFICE

CERTIFICATE OF CORRECTION

PATENT NO. : 4,130,064

DATED : December 19, 1978

INVENTOR(S) : PHILLIP P. BRIDWELL

Figure 5A:
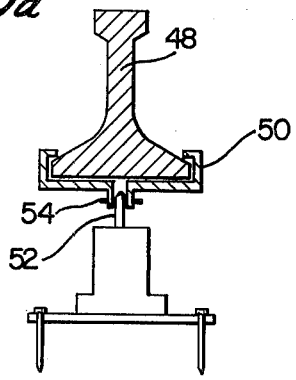
FIG. 5A is a side elevational view partly in section of a modification of the embodiment of FIG. 5.

It is certified that error appears in the above-identified patent and that said Letters Patent are hereby corrected as shown below:

Column 3, line 2, "outletlines" should be --outlet lines--.
Column 3, line 29, after "and" insertion should read --contacts on the underneath surface of rail 30. If desired, the plunger or connecting rod 46 may be welded to rail 30 or connected through a pivot arrangement as illustrated in Fig. 5a. In this alternative construction, the rail 48 is engaged--
Column 4, line 14, "vavles" should be --valves--
Column 4, line 38, "pumps" should be --pump--
Column 4, line 66, "reservor" should be --reservoir--

Claim 5, column 6, line 32 "outlet" should be --output--

Signed and Sealed this

*Eighth* Day of *May 1979*

[SEAL]

*Attest:*

RUTH C. MASON
*Attesting Officer*

DONALD W. BANNER
*Commissioner of Patents and Trademarks*